United States Patent [19]

Maye

[11] Patent Number: 4,836,393

[45] Date of Patent: Jun. 6, 1989

[54] MODULAR DISPLAY STAND

[76] Inventor: Robert Maye, 70A Greenwich Ave., New York, N.Y. 10011

[21] Appl. No.: 231,152

[22] Filed: Aug. 11, 1988

[51] Int. Cl.[4] ..... B66C 23/42

[52] U.S. Cl. ..... 211/188; 108/91; 248/174

[58] Field of Search ..... 211/186, 188, 153, 135, 211/194; 248/174; 108/111, 91, 53.1, 92, 51.3; 206/503, 511

[56] References Cited

U.S. PATENT DOCUMENTS

| | | | |
|---|---|---|---|
| 3,549,019 | 12/1970 | Wood et al. | 108/111 |
| 3,674,229 | 7/1972 | Keller | 211/188 X |
| 3,741,404 | 6/1973 | Jourdain | 108/91 |
| 3,834,324 | 9/1974 | Lang | 211/188 X |
| 4,303,020 | 12/1981 | Houle | 108/51.3 |
| 4,373,449 | 2/1983 | Klaus | 248/174 X |
| 4,428,487 | 1/1984 | Hepp | 108/91 X |
| 4,467,927 | 8/1984 | Nathan | 108/91 X |
| 4,618,115 | 10/1986 | Belokin | 211/135 X |
| 4,714,026 | 12/1987 | Yamaguchi | 108/51.3 X |

*Primary Examiner*—J. Franklin Foss

*Attorney, Agent, or Firm*—Kane, Dalsimer, Sullivan, Kurucz, Levy, Eisele and Richard

[57] ABSTRACT

A modular display stand for exhibition of articles of manufacture is described, made up basically of only three components. The stand may be assembled and disassembled without the use of tools. The stand is stable when loaded with relatively heavy loads of articles to be exhibited. Advantageously, the stand is constructed of materials, all of which can be recycled after use with minimal impact on the environment.

12 Claims, 4 Drawing Sheets

MODULAR DISPLAY STAND

BACKGROUND OF THE INVENTION

FIELD OF THE INVENTION

The invention relates to a modular, kock-down display stand.

SUMMARY OF THE INVENTION

The invention comprises a modular display stand for exhibition of articles of manufacture, which is readily assembled and disassembled without the use of tools and which is stable when loaded with relatively heavy loads of articles to be exhibited, and which when assembled comprises;

at least one shelf member which is a planar sheet having a top planar surface, a bottom planar surface, a peripheral edge between top and bottom surfaces, said peripheral edge defining the outer boundaries of the planar sheet, and a flange on the peripheral edge of the sheet, projecting away from the peripheral edge on an axis transverse to the axial plane of the sheet, said flange being integrally joined to the planar sheet;

a plurality of apertures piercing the planar sheet to provide open communication between the upper and the lower surfaces of the planar sheet at positions proximal to the flange;

a washer fixedly mounted on each of the top and the bottom planar surfaces of the sheet at the site of each aperture, in a manner whereby the opening of each washer is in axial alignment with the associated aperture;

a pin fixedly mounted in each aperture, each of said pins having a first end extending into a washer opening and above the top planar surface of the planar sheet and a second end extending into a washer opening and below the bottom planar surface of the planar sheet;

a recessed seat in the exposed face of each washer, radially disposed about the pin mounted in each aperture;

a spiral-wound paper tube having an end adapted by size and configuration to engage in a friction fit with the seat, said tube end being mounted in the seat, whereby the tube is in an erect position perpendicular to the planar sheet; and means fixed in the tube end for coupling with an end of the pin.

DETAILED DESCRIPTION OF THE PREFERRED EMBODIMENTS OF THE INVENTION

Those skilled in the art will gain an appreciation of the invention from the following description of preferred embodiments when viewed together with the attached drawings of FIGS. 1–6, inclusive.

Figure 1:
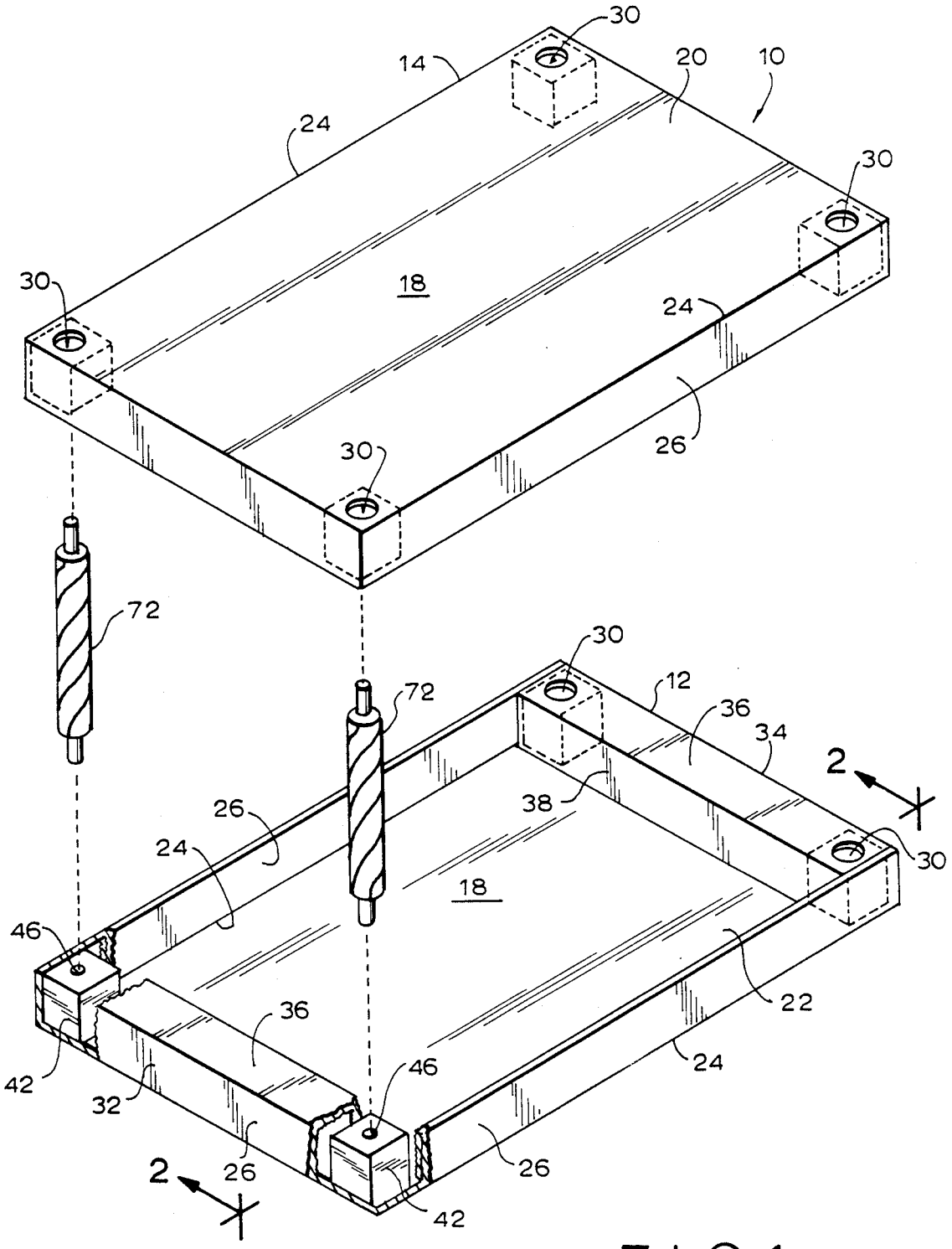
FIG. 1 is a view in perspective, exploded away, of an embodiment display unit of the invention.

Referring first to FIG. 1, there is seen a preferred embodiment display 10 of the invention shown in an exploded view.

Although the display 10 may have any number of shelf components, for clarity of description the assembly shown in FIG. 1 consists of two shelf elements. The shelf 12 is identical in construction to the shelf 14. As shown in FIG. 1, the shelf 12 is in an "upside down" disposition in comparison to the disposition of the shelf 14. This is shown to stress that the shelf components 12, 14 have no "up" side or "down" side but can be used reversibly. The shelves 12, 14 each comprise a planar sheet 18 having a top planar surface 20 and a bottom planar surface 22. A peripheral edge 24 between top and bottom surfaces 20, 22 defines the outer boundaries of the planar sheet 18. A flange 26 on the peripheral edge 24 of planar sheet 18 projects away from the peripheral edge 24 on an axis transverse to the axial plane of the sheet 18, said flange 26 being integrally joined to the planar sheet 18. A plurality of apertures 30 pierce the planar sheet 18 to provide open communication between the upper surface 20 and the lower surface 22 of planar sheet 18 at positions proximal to the flange 26.

As best seen in the lower shelf component shown in the display 10, of FIG. 1, the flange 26 at the end 32 and end 34 includes extensions which are folded over to form an inverted "U" channel. Thus, an extension 36 and an extension 38 of the flange 26 at these locations are folded so as to form the inverted "U" shaped channel. Within the "U", and positioned over the enclosed apertures 30 are washers 42. The openings 46 in washers 42, are axially aligned with the aperture 30 underlying the washers 42. These openings 46 in the washers 42 are also in axial alignment with the overlying apertures 30 in the extensions 36 of sheet 18. Thus, the apertures in the sheet 18 together with the openings 46 in the washers 42 provide open communication completely through the shelf 12 and the shelf 14. Washers 42 are located in each of the four corners of the component shelves 12, 14. Advantageously, the washers 42 are secured in each corner of the shelves 12, 14 by adhesive such as a contact cement on the sheet 18 including the extensions 36, 38 and flange 26.

Figure 2:
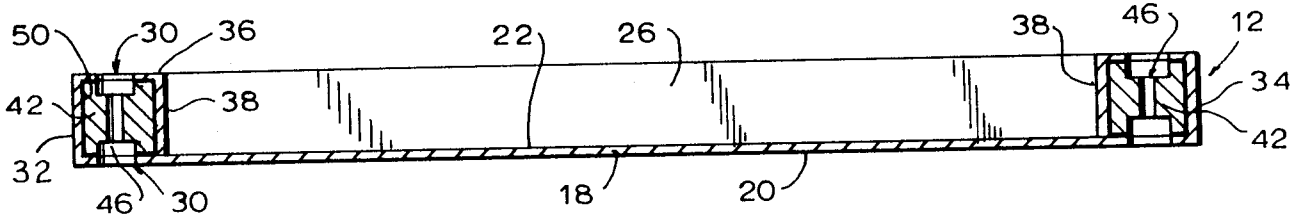
FIG. 2 is side elevation in cross-section along lines 2—2 of FIG. 1.

FIG. 2 is a cross-sectional side elevation, viewed along lines 2—2 of FIG. 1 and show in cross-section the complete enclosure of the washers 42 within the folds of the flange 26 and extensions 36, 38. Contact adhesive 50 firmly secures and solidifies the construction by adhering the washers 42 on top, bottom and three sides to the contacting sheet 18.

Figure 3:
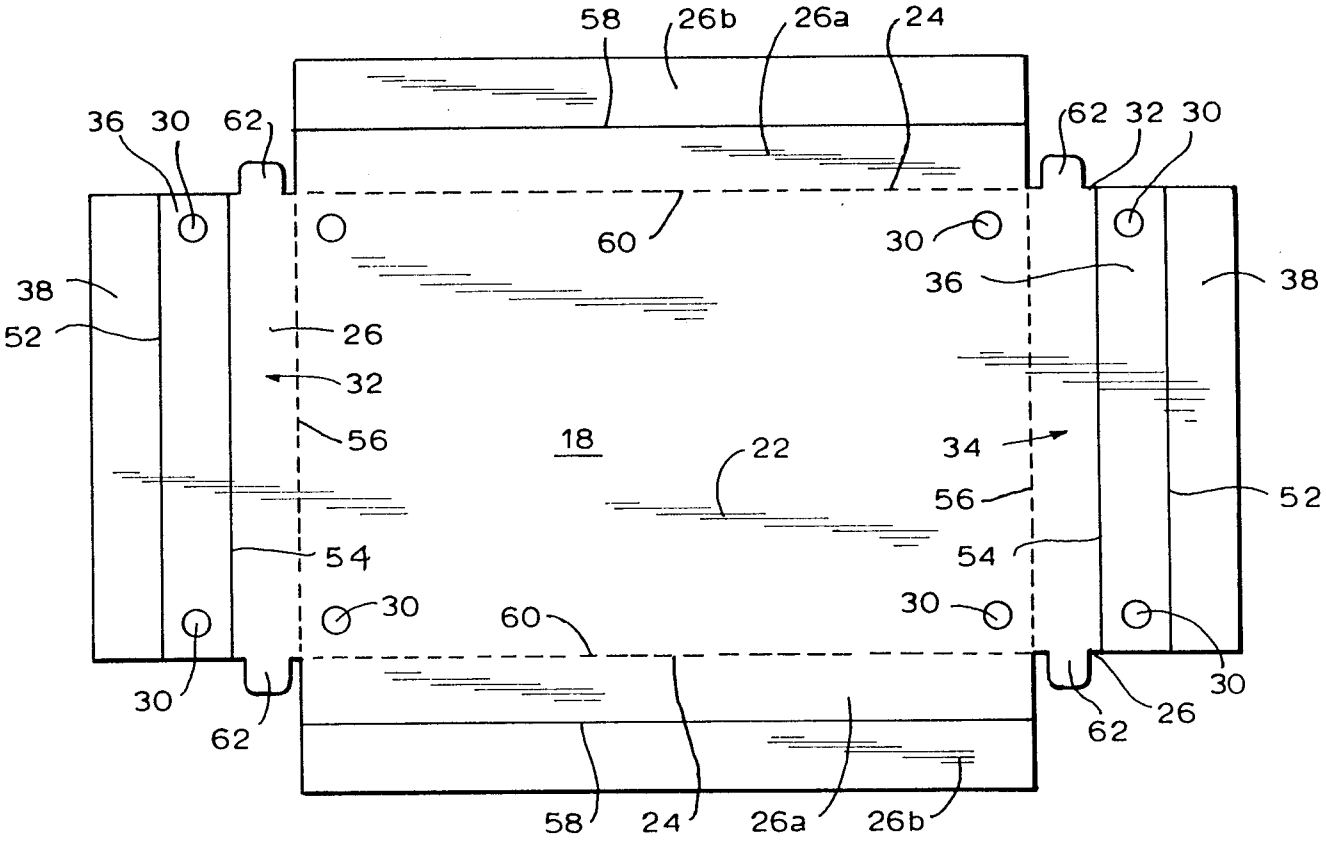
FIG. 3 is a plan view of an unassembled shelf component of the embodiment display shown in FIG. 1.

FIG. 3 is a plan view of a blank sheet 18 from which the shelves 12, 14 may be fabricated. As shown in FIG. 3, sheet 18 as viewed from surface 22 includes the apertures 30 positioned as described above. The end 32 and the end 34 include the extensions 36 and 38 respectively. Each of the ends 32, 34 include fold lines 52, 54 and 56. When folded along these fold lines, the above described inverted "U" is formed with the apertures 30 in extension 36 in axial alignment with the apertures 30 in the main portion of sheet 18 adjacent to the fold line 56 on each of ends 32, 34. The portion of flange 26 joining together the ends 32, 34 on both lateral sides of sheet 18 is made up of a portion 26a and a portion 26b separated from each other by a fold line 58. A fold line 60 on each of the peripheral edges 24 completes the construction of the blank required for fabrication of a shelf component 12, 14. When folded along the fold lines 58 and 60, a double thickness of sheet 18 is formed together to form a major portion of the flange 26. Tabs 62 on the ends of flange 26 in each end 32, 34 may be folded inside and between the folded over portions 26a, 26b to secure the flange 26 construction around the entire peripheral edge 24. The tabs 62 may be adhesively secured in place to the inside of portions 26a and 26b to maximize strength.

Figure 4:
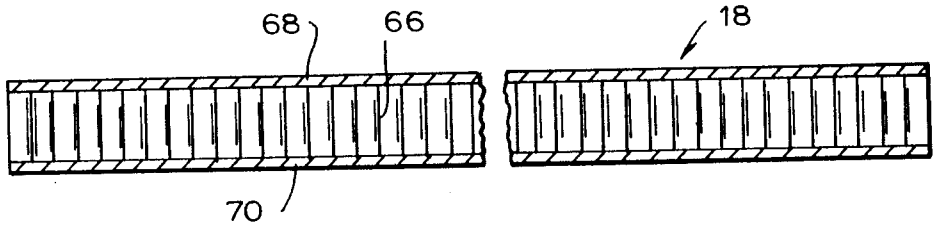
FIG. 4 is an enlarged cross-sectional view of the sheet shown in FIG. 3 and used to construct the shelf component.

The planar sheet 18 may be fabricated from any conventional material commonly employed as a low cost shelf material. Preferably, the sheet 18 is a cellulosic sheet such as a sheet of corrugated Kraft paperboard. Of course, the planar sheet 18 has to be selected from materials which will provide both compressive and bending strengths supportive of the articles to be displayed on the unit assembly 10. A preferred planar sheet 18 is one constructed from a lamination of two face sheets of paper, sandwiching a honeycomb core of paper or metal. FIG. 4 is a cross-sectional, enlarged side elevation of a preferred planar sheet 18 (fragmented) which forms at least the main portion of the sheet 18. The extensions 32, 34 and flange 26 need not contain a honeycomb core. As shown in FIG. 4, the honeycomb core 66 is sandwiched between face sheets 68, 70. Preferably, the honeycomb 66 is a paper honeycomb to provide a very lightweight, but structurally strong planar sheet 18. Honeycomb core elements for fabricating planar sheets are very well known and available in the commercial market. Paper honeycomb materials may be fabricated by methods well known in the art; see for the example the U.S. Pat. Nos. 3,518,151; 3,519,510; and 3,713,954; all of which are hereby incorporated herein by reference thereto. Methods of adhering honeycomb materials to facing sheets are also well known; see for example U.S. Pat. No. 2,815,795 which is incorporated herein by reference thereto. Also, metal honeycomb foils, referred to in the latter patent, may be employed as structural elements for the sheet 18 described above. Metal honeycomb materials and their use sandwiched between facing sheets are well known and commercially available from the Hexcel Corporation, Dublin, Calif. 94566. As is well known in the art, very high compressive strengths are associated with honeycomb sandwich structures, as are high bending strengths.

The sheet 18 need not be fabricated from a honeycomb core material even if one desires to obtain the benefits associated with such materials. For example, a separate sheet of honeycomb material as described above may be fashioned to fit snugly over the sheet 18 and within the perimeter of flange 26. The folded over ends 32, 34 will then also function to secure the underlying honeycomb core sheet in place on the surface 22 of sheet 18.

Referring again to FIG. 1, the use of the shelves 12, 14 either alone or in combination with one another and/or in combination with additional shelves 12 or 14, will be explained.

When a plurality of the shelves such as 12, 14 are employed, regardless of their orientation as to an "up" or "down" side, they are joined together by vertical support elements 72. Although a minimum of one support element 72 is all that is required for the assembly and joinder of the shelves such as shelves 12, 14, generally one will be used in each corner of the shelves. The vertical support element 72 is advantageously a spiral-wound paper tube. The technique of spirally winding tubular forms from paper is well known and need not be described herein; see for example the description in U.S. Pat. No. 3,037,529 which is hereby incorporated herein by reference thereto. The use of a spirally wound vertical support member 72 is advantageous in that it provides strength in all directions when weight is imposed vertically upon the support member 72. Interposed between each support member 72 and a shelf 12, 14 or additional shelves are the washers 42 as previously described. Each washer 42 may be identical in construction and will have openings 46 therein as previously described.

Figure 5:
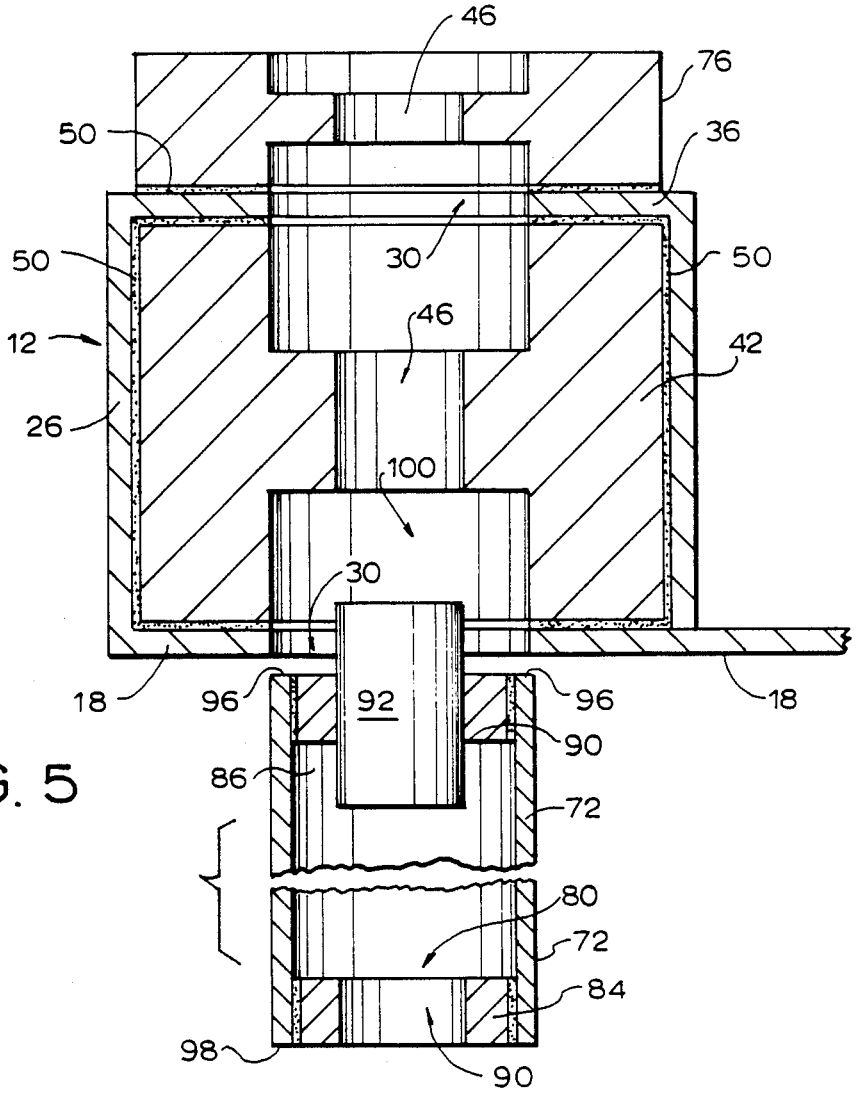
FIG. 5 is a cross-sectional side elevation showing a fragmentary part of the vertical tube component employed in construction of the embodiment display of FIG. 1, shown with exploded views of the connecting elements.

Referring now to FIG. 5, an enlarged, exploded view of one end of a display stand 10 in cross-section, one can see how the vertical support member 72 is coupled through the agency of washers 42 to sheet 18. The fragmented view of vertical support member 72 shows that a hollow and spiral wound paper tube encloses a chamber 80. The ends of the spiral wound paper tube member 72 are closed with end caps 84, 86 bearing in each a bore 90. The upper end cap 86 is shown in FIG. 5 to contain within the bore 90 a pin 92. The pin 92 is secured within bore 90 by frictional fit or, preferably, by an adhesive. The washers 42 are positioned so that the opening 46 is in axial alignment with the apertures 30 in sheet 18 including aperture 30 in extension 36. As previously stated, the washers 42 are adhesively secured in position to the interposed sheet 18 by adhesive 50. With the washers 42 in place and adhesively secured to the sheet 18, the apertures 30 and openings 46 are in axial alignment to receive therethrough an extended end of pin 92 from the underlying spirally wound vertical support member 72 and a like vertically aligned support member 72 (not shown) above the washer 42 on the upper surface of extension 36 of sheet 18. With the pin 92 fully inserted into the opening 46 of the washer 42, the end 96 of the member 72 is received into a recessed seat 100 radially disposed about the opening 46 in washer 42. The pins 92 from an upper member 72 and from a lower member 72 meet in the opening 46 of an interposed washer 42. The end 96 of member 72 is adapted by size and configuration to fit snugly, i.e., an interference fit, into the recessed seat 100. The end 96 may be adhesively secured to the recessed seat 100 with advantages of strength in the connection. The opposite end 98 of support member 72 may also be fitted into a recessed seat 100 of a washer 42 component of another shelf attached to that end of member 72. Similarly, a pin 92 may be inserted into the bore 90 at end 98 of the support member 72, to complete coupling of the support member 72 to a lower washer 42 of another shelf component such as shelf 12 or 14. In this way, a high degree of cross-rigidity is obtained in the structure and assembly 10. Great strength is obtained in all directions of the completed assembly 10 because of the secured pins 92, and washers 42. The washers are further secured in place by the adhesive security afforded by the enveloping extensions 32, 34 of the planar sheet 18.

As also shown in FIG. 5, a second washer 76 may be inserted in the display stand 10 between the vertical support member 72 and the shelf 12 or 14 and affixed with an adhesive 50. The washer 76 is identical to a washer 42 and is mounted with the opening 46 in axial alignment with the apertures 30. In this preferred embodiment construction, a very high degree of rigidity between the member 72 and shelves 12, 14 is obtained.

Figure 6:
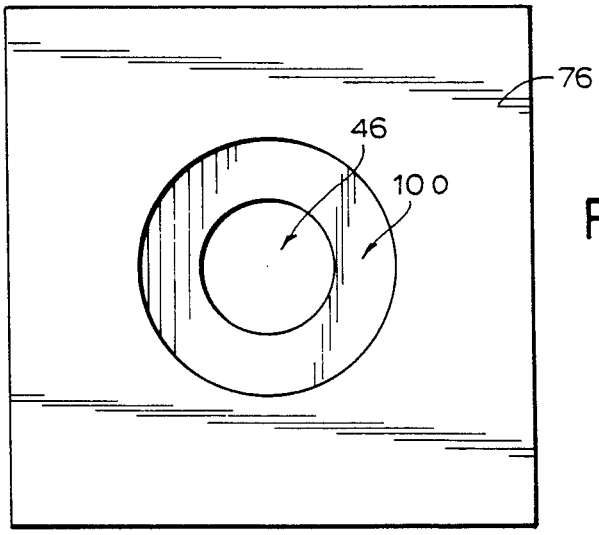
FIG. 6 is a view from above of a washer component shown in FIG. 5.

FIG. 6 is a top view of a typical washer 42, 76 showing the opening 46 and the recessed seat 100 radially disposed about the opening 46. The washers 42, 76 can be fabricated in any desired shape (round, oval, square, rectangular) or material, preferably plastic or wood.

It will be appreciated by those skilled in the art that many modifications may be made to the above described preferred embodiment of the display assembly 10 without departing from the spirit and the scope of the invention. For example, the pins 92 may be grooved to facilitate the use of an adhesive to secure them in place. Also the pins 92 may bear on the outer walls thereof a screw thread for mating with screw threads on the interior walls of the opening 46. With this particular structural arrangement, the pins 92 may be screwed in and threaded to the upright member 72 for ease of assembly.

In any event, it will also be appreciated by those skilled in the art that the assembly 10 may be put together or knocked down without a requirement for tools of any sort. For storage and shipment, the vertical support members 72 and washers 42, 76 can be disassembled and carried in the enclosure of flange 26 on the surface 22 of sheet 18. Also, since the shelves 12, 14 and any additional shelf components are identical in construction, small inventories may be maintained and manufacturing is facilitated. Likewise, only one set of washer components and one set of upright spiral supports 72 are required. In essence, there are only three basic components of the assemblies 10, i.e., the shelves 12, 14 and a spirally wound paper tube support member 72 with its integral pin 92. With these two basic components, display units of any size may be constructed without the use of tools, having great strength and stability.

What is claimed is:

1. A modular display stand for exhibition of articles of manufacture, which is readily assembled and disassembled without the use of tools and which is stable when loaded with relatively heavy loads of articles to be exhibited, and which when assembled comprises;

at least one shelf member which is a planar sheet having a top planar surface, a bottom planar surface, a peripheral edge between top and bottom surfaces, said peripheral edge defining the outer boundaries of the planar sheet, and a flange on the peripheral edge of the sheet, projecting away from the peripheral edge on an axis transverse to the axial plane of the sheet, said flange being integrally joined to the planar sheet;

a plurality of apertures piercing the planar sheet to provide open communication between the upper and the lower surfaces of the planar sheet at positions proximal to the flange;

a washer fixedly mounted on a planar surface of the sheet at the site of each aperture, in a manner whereby the opening of each washer is in axial alignment with the associated aperture, said mounted washer having a first surface adjacent the planar surface and a second, exposed face surface;

a pin fixedly mounted in each aperture, each of said pins having a first end extending above the plane of the top planar surface of the planar sheet and a second end extending below the plane of the bottom planar surface of the planar sheet;

a recessed seat in the exposed face of each washer, radially disposed about the pin mounted in each aperture;

a spiral-wound paper tube support member having an end adapted by size and configuration to engage in a frictional fit with the seat, said tube end being mounted in the seat, whereby the tube is in an erect vertical position perpendicular to the plane of the planar sheet; and means fixed in the tube end for coupling with an end of the pin.

2. The stand of claim 1 having a plurality of shelf members, arranged in a vertical stack with a plurality of interposed spiral-wound support members.

3. The stand of claim 1 wherein there are flange extensions folded over to form an inverted U channel at two opposite ends of the planar sheet.

4. The stand of claim 3 wherein the washer is adhesively fixed in the U channel.

5. The stand of claim 1 wherein the washer is rectangular.

6. The stand of claim 1 fabricated from all cellulosic materials.

7. The stand of claim 1 wherein the planar sheet is a laminate including a honeycomb core sandwiched between paper face sheets.

8. The stand of claim 1 wherein the planar sheet is manufactured from corrugated Kraft board.

9. The stand of claim 8 which further comprises a laminate including a honeycomb core sandwiched between paper dface sheets, secured to one surface of the planar sheet.

10. A modular display stand for exhibition of articles of manufacture, which is readily assembled and disassembled without the use of tools and which is stable when loaded with relatively heavy loads of articles to be exhibited and which when assembled comprises;

(A) A plurality of shelf members, said shelf members each comprising;

1. a planar sheet, having (a) a top surface with four corners;

(b) a bottom surface;

(c) a first peripheral edge;

(d) a second peripheral edge opposite the first peripheral edge;

(e) a third peripheral edge between and joining together the first and second peripheral edges;

(f) a fourth peripheral edge opposite the third peripheral edge, between and joining together the first and second peripheral edges; said first, second, third and fourth edges together defining the outer boundaries of the planar sheet between top and bottom surfaces;

(g) flanges on the first, second, third and fourth edges projecting away from the peripheral edge on an axis transverse to the axial plane of the sheet, said flange being integrally joined to the planar sheet, and to each other at the corners and having a free edge;

(h) a first flange extension on the free edge of the first peripheral edge flange, folded inwardly towards the top surface of the planar sheet to meet therewith and form an inverted U-channel; and (i) a second flange extension on the free edge of the second peripheral edge flange, folded inwardly towards the top surface of the planar sheet to meet therewith and form an inverted U-channel;

2. a laminate of a honeycomb core sandwiched between first and second face sheets, secured in place over the top surface of the planar sheet by the first and second flange extensions; and
3. four washers, each one adhesively secured within one of the U-shaped channels and each one located in a separate corner of the planar sheet on the top surface, said washers each having
   (a) a top surface;
   (b) a bottom surface;
   (c) a washer body between the washer top surface and the washer bottom surface;
   (d) an opening centrally located in the washer body and communicating between the washer top and bottom surfaces;
   (e) a recessed seat in the washer top surface, radially disposed about the central opening in the washer; and
4. a plurality of apertures into the U-shaped channels, in axial alignment with and providing communication between each washer opening and the outside of the U-shaped channels; said plurality of shelf members being positioned in a vertical array; and B. a plurality of spiral-wound, paper tubes each seated in a recessed seat of each washer in adjacent shelf members of the vertical array and connecting adjacent shelf members together, said tubes having
   1. a tube body;
   2. tube body ends; and
   3. pin means fixed in the tube ends for coupling with a washer by engagement with the washer opening;

said tube body ends being adapted by size and configuration to seat in the recessed seat of the washer;

further provided that the washers in shelf members between an upper and a lower shelf member additionally have a recessed seat in the washer bottom surface, radially disposed about the central opening in the washer to seat the spiralwound tube seated in the lower shelf member.

11. The stand of claim 10 which is fabricated from cellulosic materials.

12. The stand of claim 10 which further comprises additional washers between the tube ends and the shelf members.

* * * * *